US011072943B2

(12) United States Patent
Sun et al.

(10) Patent No.: US 11,072,943 B2
(45) Date of Patent: Jul. 27, 2021

(54) FOLDING TENT WITH AUTOMATIC CORNICE STRUCTURE

(71) Applicant: ZHEJIANG JIANSHENG LEISURE PRODUCTS CO., LTD, Zhejiang (CN)

(72) Inventors: Yuanru Sun, Zhejiang (CN); Chao Zeng, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 0 days.

(21) Appl. No.: 16/628,680

(22) PCT Filed: Apr. 29, 2019

(86) PCT No.: PCT/CN2019/084962

§ 371 (c)(1),
(2) Date: Jan. 6, 2020

(87) PCT Pub. No.: WO2020/133855

PCT Pub. Date: Jul. 2, 2020

(65) Prior Publication Data

US 2021/0040766 A1 Feb. 11, 2021

(30) Foreign Application Priority Data

Dec. 27, 2018 (CN) ..... 201811612416.3
Dec. 27, 2018 (CN) ..... 201822221842.6

(51) Int. Cl.
*E04H 15/50* (2006.01)
*E04H 15/32* (2006.01)

(52) U.S. Cl.
CPC ..... *E04H 15/50* (2013.01); *E04H 15/32* (2013.01)

(58) Field of Classification Search
CPC ..... E04H 15/50; E04H 15/32
See application file for complete search history.

(56) References Cited

U.S. PATENT DOCUMENTS 7,367,348 B2 * 5/2008 Tsai ..... E04H 15/50 135/122
8,544,489 B2 * 10/2013 Choi ..... E04H 15/50 135/145

(Continued)

FOREIGN PATENT DOCUMENTS

| | | |
|---|---|---|
| CN | 206128828 | 4/2017 |
| CN | 206616931 | 11/2017 |
| CN | 107476647 | 12/2017 |

OTHER PUBLICATIONS

"International Search Report (Form PCT/ISA/210) of PCT/CN2019/084962," dated Sep. 26, 2019, pp. 1-5.

*Primary Examiner* — David R Dunn
*Assistant Examiner* — Danielle Jackson
(74) *Attorney, Agent, or Firm* — JCIP Global Inc.

(57) ABSTRACT

A folding tent with automatic cornice structure includes a folding tent body including a leg tube and a folding rod assembly that are installed by a leg tube slider and a leg tube top member. The folding tent further includes a cornice assembly including a connection sleeve group that includes a first sliding sleeve, a second sliding sleeve and a third sliding sleeve, and a cornice rod group that includes a cornice rod, a diagonal draw rod and a push rod. The first sliding sleeve is slidably cooperated with the cornice rod and is hingedly cooperated with the push rod. The second sliding sleeve is fixedly cooperated with the push rod, is slidably cooperated with a folding top rod, and is hingedly cooperated with the diagonal draw rod. The third sliding sleeve is fixedly cooperated with the folding top rod, and is hingedly cooperated with a folding diagonal rod.

10 Claims, 11 Drawing Sheets

(56) References Cited

U.S. PATENT DOCUMENTS

| | | | | |
|---|---|---|---|---|
| 8,701,692 | B2 * | 4/2014 | Holland | E04H 15/46 135/145 |
| 9,739,073 | B2 * | 8/2017 | Huang | E04H 15/322 |
| 10,113,329 | B2 * | 10/2018 | Choi | E04H 15/46 |
| 10,119,297 | B2 * | 11/2018 | Choi | E04H 15/46 |
| 10,280,645 | B1 * | 5/2019 | Yang | E04H 15/18 |
| 10,309,121 | B2 * | 6/2019 | Choi | E04H 15/58 |
| 10,697,196 | B2 * | 6/2020 | Nicholson, Jr. | E04H 15/58 |
| 2007/0051397 | A1 * | 3/2007 | Choi | E04H 15/50 135/131 |
| 2010/0043856 | A1 * | 2/2010 | Park | E04H 15/50 135/145 |
| 2020/0157838 | A1 * | 5/2020 | Yuan | E04H 15/48 |

* cited by examiner

FOLDING TENT WITH AUTOMATIC CORNICE STRUCTURE

CROSS-REFERENCE TO RELATED APPLICATION

This application is a 371 of international application of PCT application serial no. PCT/CN2019/084962, filed on Apr. 29, 2019, which claims the priority benefit of China applications no. 201811612416.3 and no. 201822221842.6 filed on Dec. 27, 2018. The entirety of each of the above mentioned patent applications is hereby incorporated by reference herein and made a part of this specification.

BACKGROUND

Technical Field

The present invention relates to the technical field of folding tents, in particular, to a folding tent with automatic cornice structure.

Description of Related Art

The structure of the tent is various, and the tent used for outdoor sunshade is usually a folding tent. Traditional folding tents have a smaller shade area. In order to increase the shade area after the tent is extended, there is a cornice-type tent with a cornice structure, wherein there is a protruding cornice rod at a top corner of the tent, and the shade area can be increased by a surrounding edge provided on the cornice rod. It is mainly by pivoting the cornice rod or inserting the cornice rod on a top rod of the tent rack, and an outer end of the cornice rod protrudes movably outside the respective columns. However, in the current folding tent, the cornice rod is independently arranged with respect to the tent body bracket, and operation in two steps should be performed when unfolding or folding. That is to say, when unfolding, the tent body rack should be unfolded first, and then the cornice rods should be opened or pulled one by one. Since the cornice rod is in a higher position, it is inconvenient to realize the operation. When folding, the operation is reversed, and the same problem exists. Therefore, the existing folding tent has a complicated structure, and the folding operation is cumbersome and inconvenient.

To this end, CN107476647A discloses a foldable tent, wherein the sun-shading area thereof is large and the cornice rod can be unfolded and folded together with a first top rod, which is convenient to operate. After unfolding, the transmission member has a reinforcing effect on the second top rod. It comprises a column assembly and a rack assembly including a first rack, a second rack and a cornice rod. An inner end of the first rack is rotatably connected, and an outer end of the first rack is rotatably connected to an inner end of the second rack. An outer end of the second rack, an inner end of the cornice rod, and an upper end of the column assembly are rotationally connected or coaxially connected to each other. When the tent is in an unfolded state, the first rack, the second rack and the cornice rod are respectively unfolded and an outer end of the cornice rod extends to the outside of the corresponding column assembly. When the tent is in a folded state, the first rack, the second rack and the cornice rod are respectively close to each other. Each rack assembly further includes a transmission member connected between the first rack and the cornice rod for unfolding or folding the cornice rod and the first rack. The disclosure includes a transmission member connected between the first rack and the cornice rod for expanding or folding the cornice rod with the first rack, and the transmission member is a transmission rod rotatably connected between the first rack and the cornice rod. A four-linkage mechanism is formed between the first rack, the second rack, the cornice rod and the transmission rod. The four rods are linked and folded and extended relative to each other. The transmission rod has an inner end pivotally connected to the outer end of the first rack and an outer end pivotally coupled to the inner end of the cornice rod. The connection between the transmission rod and the first rack is located outside a junction of the second rack and the first rack, and the connection between the transmission rod and the cornice rod is located outside a junction of the second rack and the cornice rod. The connection points of the joints in the overall cornice structure are fixed positions, resulting in a longer size of the transmission rod. In addition, the inner end of the transmission rod is at the position where the first rack and the second rack are connected, and in the whole folding tent storage process, due to the relatively long length, especially in some large folding tents, due to the existence of a multi-stage folding mechanism, it is easy to cause a problem of interference with the remaining rods, affecting the storage effect. Further, since the cornice structure is completed and a four-linkage mechanism is adopted, when the wind is large, it is prone to sway and affect the use effect.

SUMMARY

Regarding the problems above, the present invention aims at providing a folding tent with automatic cornice structure, which has the advantages of convenient and quick contraction and more reasonable rationality of the cornice transmission structure.

The technical problem solved by the present invention may be implemented by the following technical solutions:

A folding tent with automatic cornice structure includes a folding tent body including a leg tube and a folding rod assembly that are installed by a leg tube slider and a leg tube top member. The folding tent further includes a cornice assembly including a connection sleeve group that includes a first sliding sleeve, a second sliding sleeve and a third sliding sleeve, and a cornice rod group that includes a cornice rod, a diagonal draw rod and a push rod. The first sliding sleeve is slidably cooperated with the cornice rod and is hingedly cooperated with the push rod, and the second sliding sleeve is fixedly cooperated with the push rod, is slidably cooperated with a folding top rod, and is hingedly cooperated with the diagonal draw rod, and the third sliding sleeve is fixedly cooperated with the folding top rod, and is hingedly cooperated with a folding diagonal rod.

When the folding tent is in a retracted state, an open end of the cornice rod is in an inward position. When the folding tent is in an extended state, the open end of the cornice rod is in an outward position. When the folding tent is converted from the retracted state to the extended state, the first sliding sleeve gradually slides toward a hinge end of the cornice rod, and when the first sliding sleeve slides to an extreme position, the cornice rod starts to flip, and the first sliding sleeve gradually slides toward the open end until the folding tent is fully opened. A pitch is provided between the extreme position and a position of the hinged end of the cornice rod.

One end of the cornice rod is hingedly cooperated with the leg tube top member, and the first sliding sleeve is slid along the cornice rod by pushing of the push rod.

When the folding tent is in the retracted state, an end of the push rod away from a hinged position thereof with the first sliding sleeve is at an innermost position. When the folding tent is in the extended state, the end of the push rod away from the hinged position thereof with the first sliding sleeve is at an outermost position. When the folding tent is converted from the retracted state to the extended state, the diagonal draw rod drives the second sliding sleeve to move outward along the folding top rod, and drives the push rod to move outward, and a sliding stroke of the second sliding sleeve is between the third sliding sleeve and a hinged position of the folding top rod and the leg tube top member.

A middle portion of the push rod is fixedly mounted with the second sliding sleeve, one end of the push rod is hingedly mounted to the first sliding sleeve, and the other end of the push rod is sleeved on the third sliding sleeve to form a sliding cooperation.

The push rod includes a first push rod portion and a second push rod portion, and the second push rod portion is configured to telescopically slide on the third sliding sleeve.

The leg tube top member is provided with a cornice rod mounting groove and a folding top rod hinge groove, and the cornice rod is hingedly cooperated with a groove wall of the cornice rod mounting groove.

One side of the cornice rod mounting groove is provided with a push rod placement groove.

The second sliding sleeve is provided with a second hinged lug configured to be hingedly cooperated with one end of the diagonal draw rod, and the other end of the diagonal draw rod is hingedly cooperated with the folding diagonal rod, and the second sliding sleeve is further provided with a second push rod perforation and a second folding top rod perforation.

The third sliding sleeve is provided with a third hinged lug configured to be cooperated with the folding diagonal rod, and the third sliding sleeve is further provided with a third push rod perforation and a third folding top rod perforation.

By optimizing the design, the present invention optimizes the movable structure of the push rod, and adopts a structural design in which the center is fixedly combined with the two ends for sliding, so that the push rod can achieve good smoothing, shortening a length of the push rod and avoiding interference. In addition, by combining the first sliding sleeve with the push rod, a force receiving point of the cornice rod can be in an active state, which facilitates the turning of the cornice rod. At the same time, the cornice rod is limited by the first sliding sleeve and the push rod to increase the stability of the cornice.

The features of the present invention can be clearly understood from the description of the drawings and the detailed description of the preferred embodiments.

DESCRIPTION OF THE EMBODIMENTS

Figure 1:
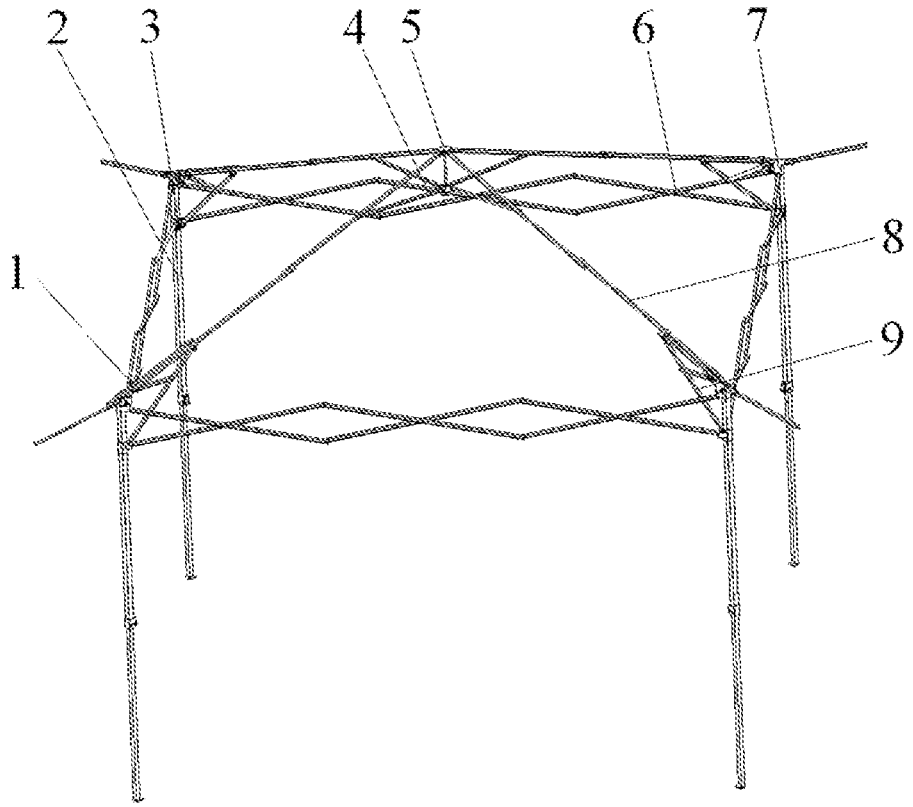
FIG. 1 is a perspective view of an overall expansion structure of the present invention.
Figure 2:
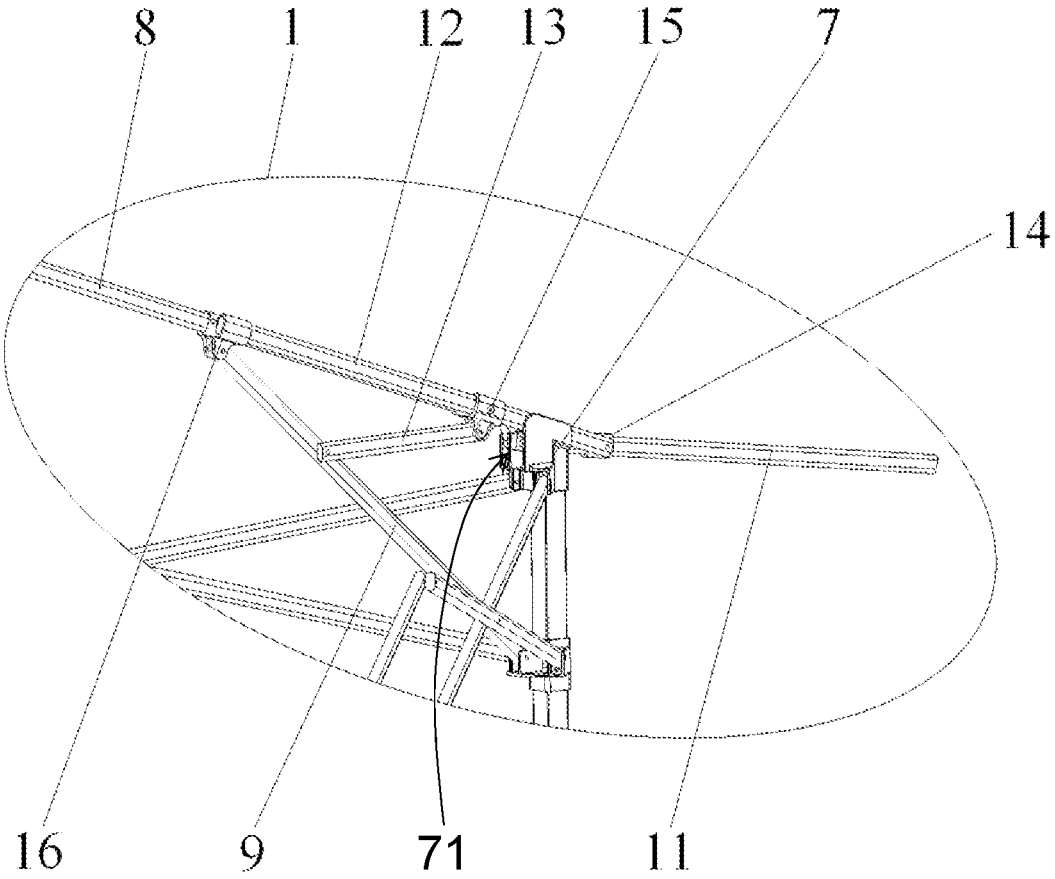
FIG. 2 is an enlarged view of a structure of a cornice assembly of the present invention.

In order to make the technical means, creative features, achievement goals and effects achieved by the present invention easy to understand, the present invention will be further described below in conjunction with specific illustrations.

Terms "inner" and "outer" defined herein are all referenced to the position of the center point of the folding tent, which is closer to the center of the folding tent, and vice versa.

As shown in FIGS. 1 to 13, the present invention provides a folding tent with automatic cornice structure, comprising a folding tent body including a leg tube 2 and a folding rod assembly. The leg tube 2 and the folding rod assembly are installed by a leg tube slider 3 and a leg tube top member 7.

The leg tube 2, the leg tube slider 3 and the folding rod assembly of the above folding tent body may adopt the corresponding structures in the existing folding tent, wherein the leg tube 2 is at least 2 pieces, and conventionally 4 or 6 pieces, and wherein there are also some multi-top folding tents, which may be 8 or the like. The folding rod assembly includes a central lock assembly 5 at a central portion and a plurality of central rods 4 hingedly cooperated with the central lock assembly 5, and a side rod assembly 6 is further provided between the leg tubes 2, wherein the central lock assembly 5, the side rod assembly 6, the leg tube slider 3, the leg tube 2, the central rods 4 and the like are all prior art structural features, and the corresponding connection relationship is a conventional structural design in the folding tent.

Figure 3:
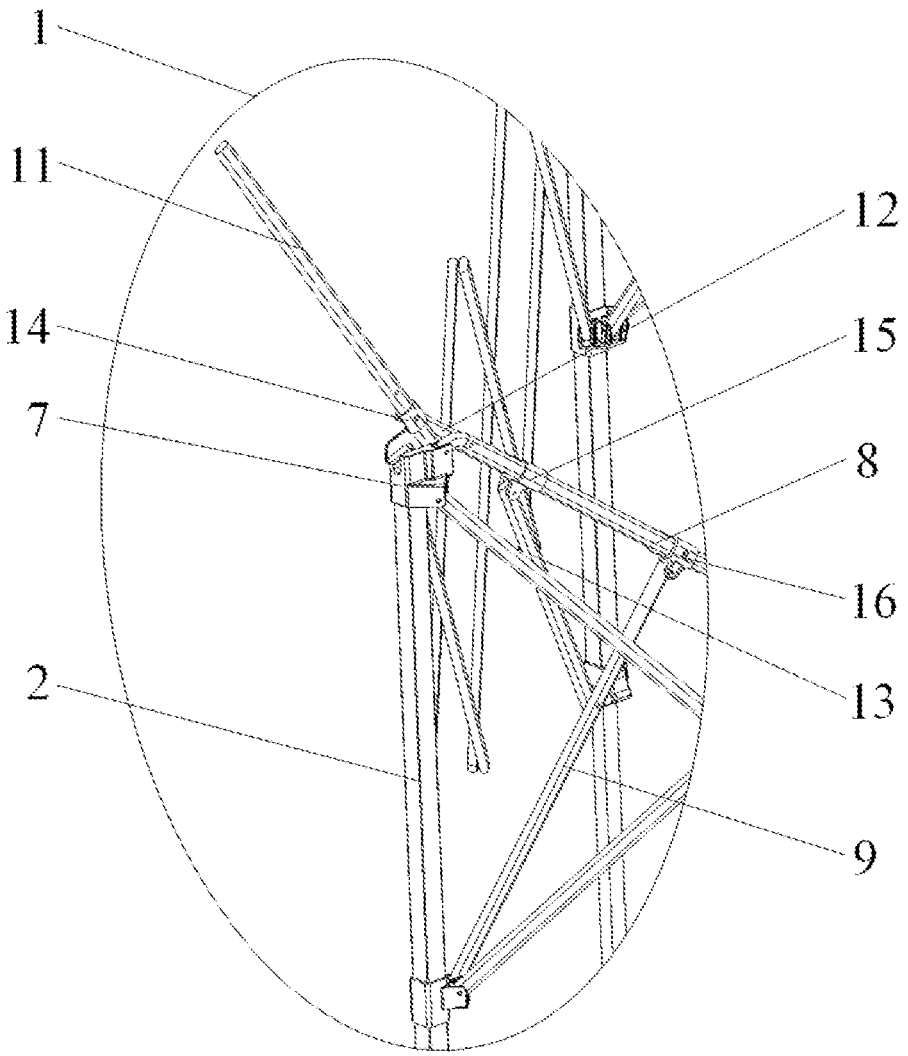
FIG. 3 is another enlarged view of the structure of a cornice assembly of the present invention.
Figure 3A:
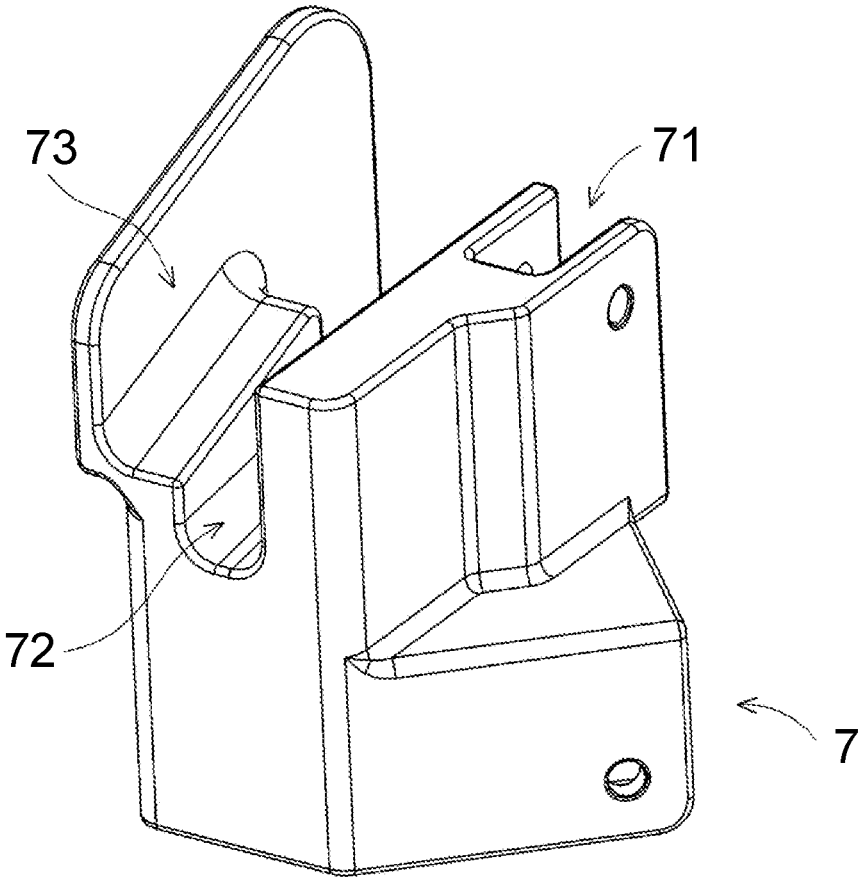
FIG. 3A illustrates a structure of a leg tube top member in FIG. 3.
Figure 4:
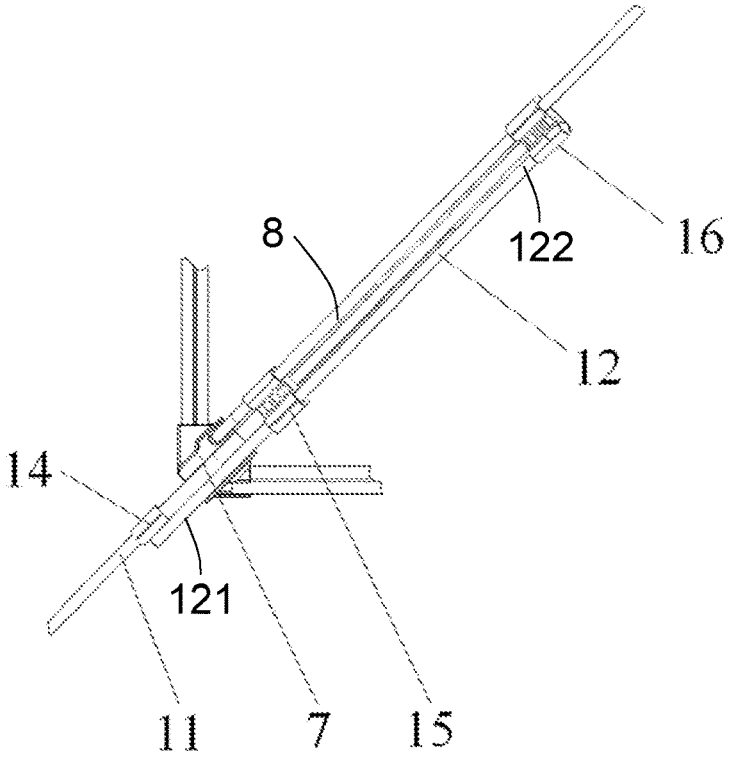
FIG. 4 is a view of the structure of a cornice assembly of the present invention.
Figure 5:
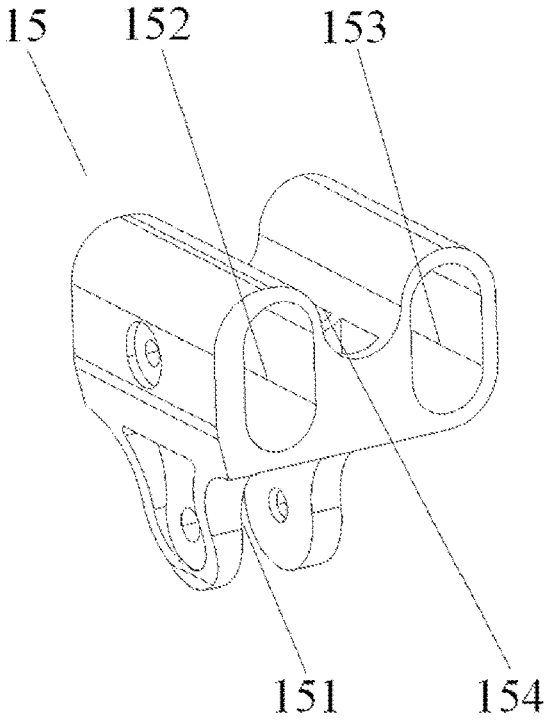
FIG. 5 is a view of a structure of the second sliding sleeve of the present invention.
Figure 6:
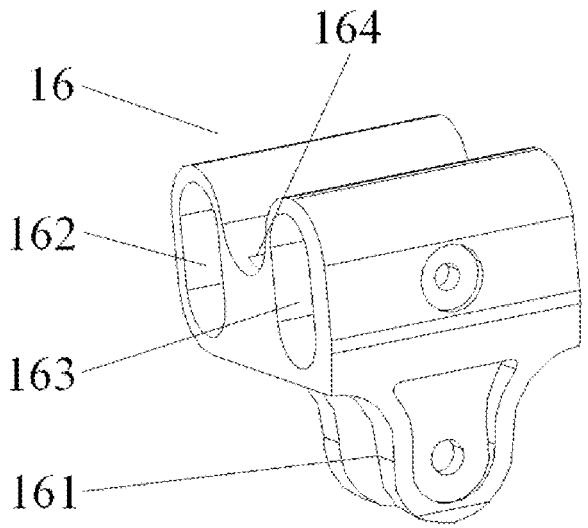
FIG. 6 is a view of a structure of the third sliding sleeve of the present invention.
Figure 7:
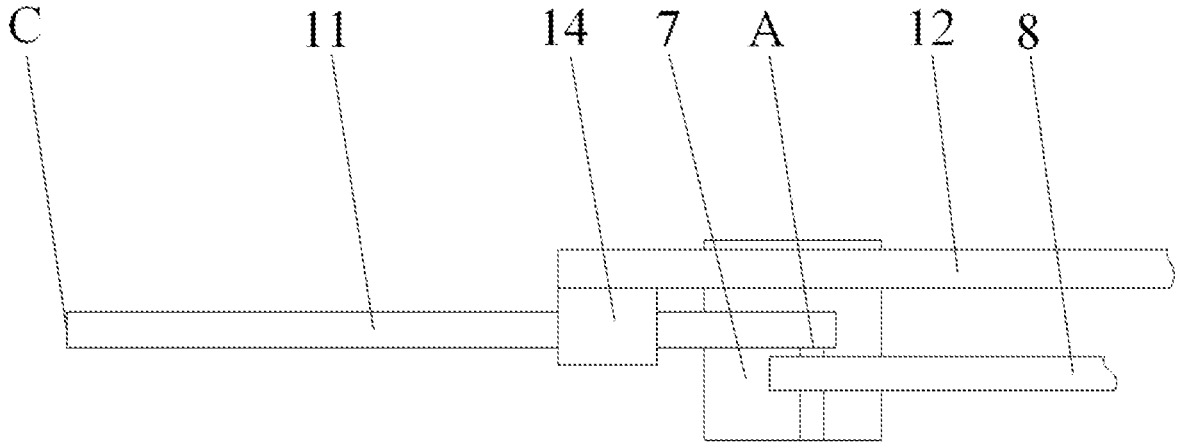
FIG. 7 is a view showing the structure of the cornice assembly of the present invention in a state in which the cornice rod is turned over.
Figure 8:
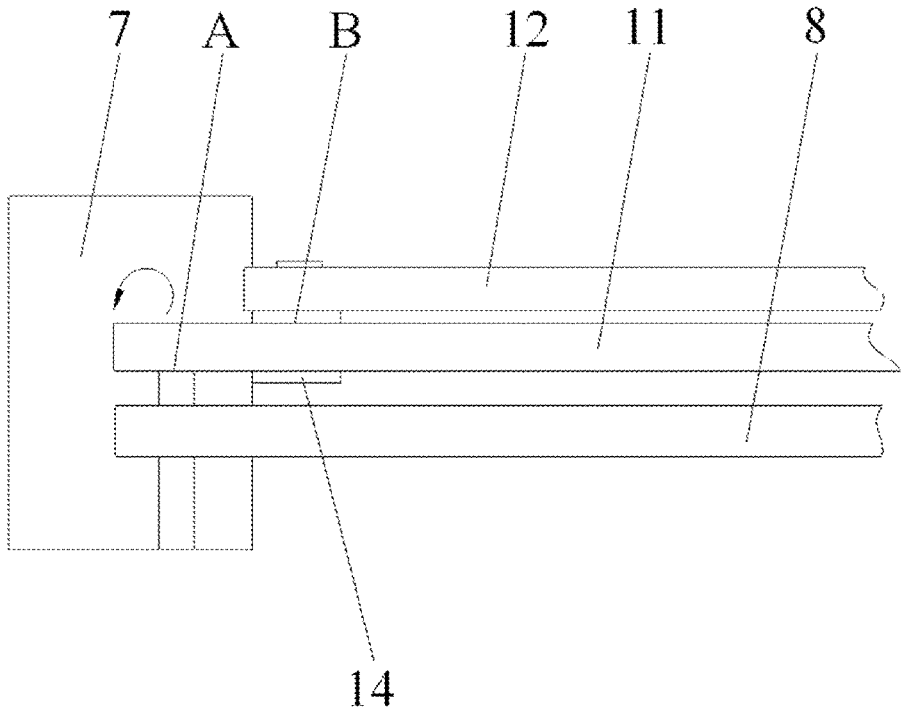
FIG. 8 is a view showing the structure of the cornice assembly of the present invention in a state in which the cornice rod is about to be turned over.
Figure 9:
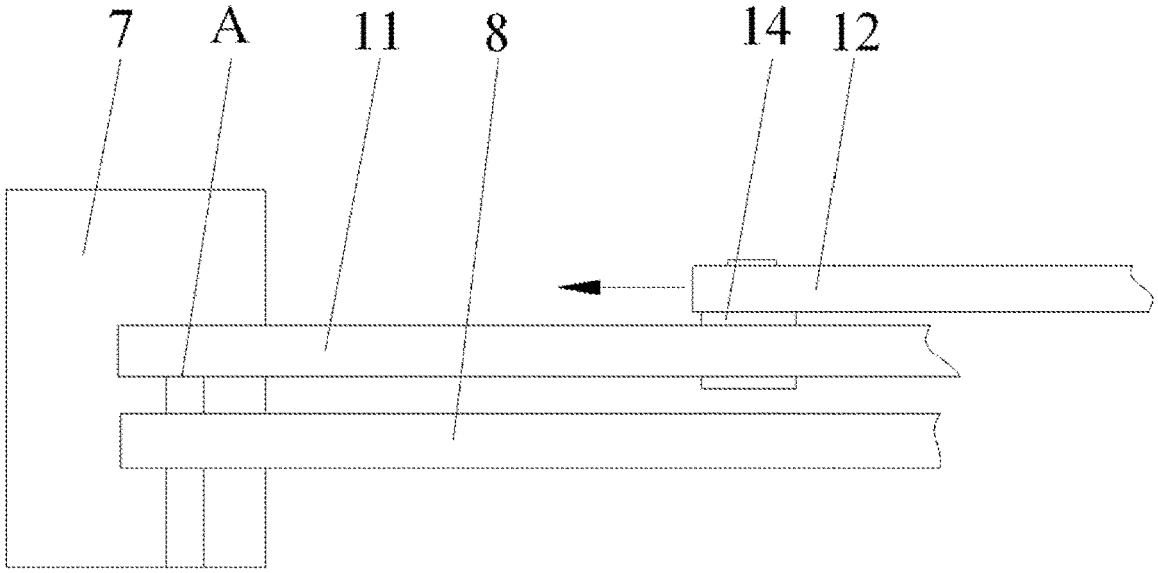
FIG. 9 is a view showing the structure of the cornice assembly of the present invention in a state in which the cornice rod is not turned over.
Figure 10:
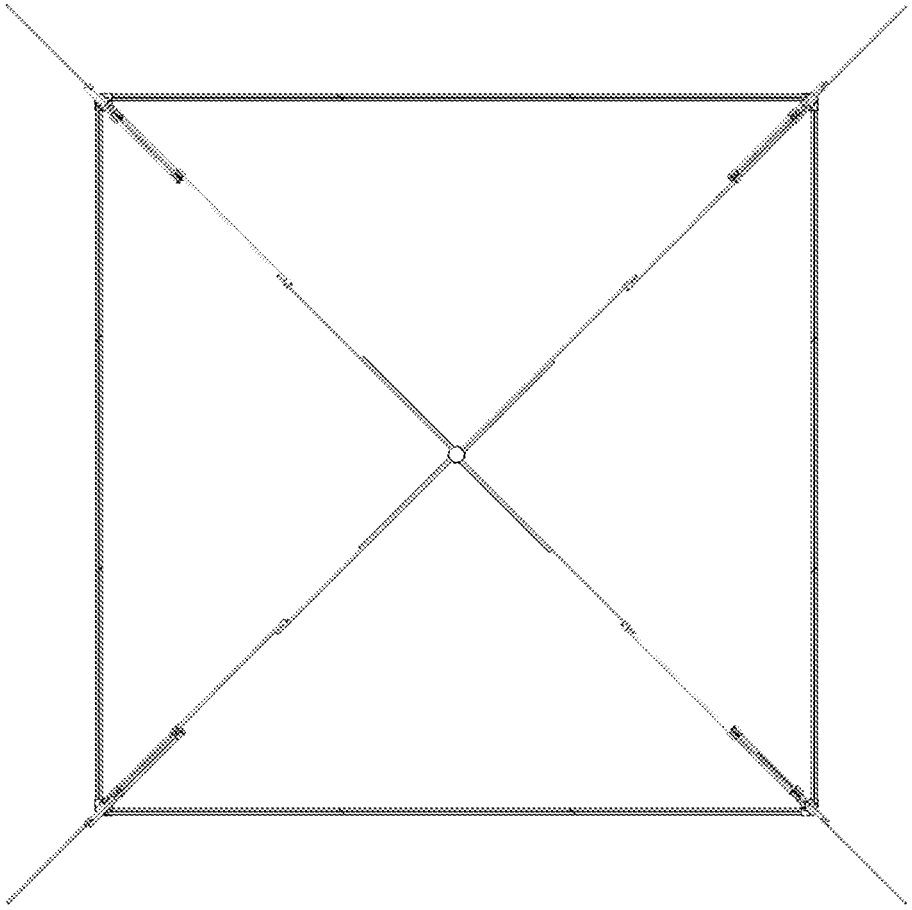
FIG. 10 is a top view of the overall expansion structure of the present invention.

Among them, as shown in FIG. 3 and FIG. 3A, the leg tube top member 7 is provided with a cornice rod mounting groove 72 and a folding top rod hinge groove 71, and the cornice rod 11 is hingedly cooperated with a groove wall of the cornice rod mounting groove 72. One side of the cornice rod mounting groove 72 is provided with a push rod placement groove 73. The structure of the leg tube top member 7 may be optimized to effectively cooperate with the structure of the cornice assembly 1.

Among them, the cornice assembly 1 includes a connection sleeve group that includes a first sliding sleeve 14, a second sliding sleeve 15 and a third sliding sleeve 16, and a cornice rod group that includes a cornice rod 11, a diagonal draw rod 13 and a push rod 12.

Among them, the first sliding sleeve 14 is slidably cooperated with the cornice rod 11, the first sliding sleeve 14 is hingedly cooperated with the push rod 12, one end of the cornice rod 11 is hingedly cooperated with the leg tube top member 7, and the first sliding sleeve 14 slides along the cornice rod 11 by the pushing of the push rod 12. When the folding tent is in a retracted state, an open end C of the cornice rod 11 is in an inward position. When the folding tent is in a unfolded state, the open end C of the cornice rod 11 is in an outward position. When the folding tent is converted from the retracted state to the extended state, the first sliding sleeve 14 gradually slides toward a hinge end A of the cornice rod 11, and when the first sliding sleeve 14 slides to an extreme position B, the cornice rod 11 starts to flip, and the first sliding sleeve 14 gradually slides toward the open end C until the folding tent is fully opened. A pitch is provided between the extreme position B and a position of the hinged end A of the cornice rod 11.

In the above, the open end C and the hinged end A are respectively located at both ends of the cornice rod 11. For the extreme position B, a distance between the extreme position B and the hinged end A is different due to the different sizes of folding tents, and the distance must be set between the extreme position B and the hinged end A, which is for better driving of the cornice rod 11 during the turning process. There is an arcuate pitch during the turning process of the cornice rod 11, a curve of the sliding of the first sliding sleeve 14 is an arcuate path, and the first sliding sleeve 14 is also gradually moved to the open end C during the sliding process until the folding tent is fully opened. When the folding tent is fully opened, the pitch between the first sliding sleeve 14 and the hinged end A is greater than the pitch between the extreme position B and the hinged end A.

Among them, the second sliding sleeve 15 is fixedly coupled with the push rod 12, the second sliding sleeve 15 slidably coupled with the folding top rod 8, the second sliding sleeve 15 is hingedly coupled with the diagonal draw rod 13, the third sliding sleeve 16 is slidably cooperated with the push rod 12, the third sliding sleeve 16 is fixedly cooperated with the folding top rod 8, the third sliding sleeve 16 is hingedly cooperated with a folding diagonal rod 9, a middle portion of the push rod 12 is fixedly mounted to the second sliding sleeve 15, one end of the push rod 12 is hingedly mounted to the first sliding sleeve 14, and the other end of the push rod 12 is sleeved on the third sliding sleeve 16. The push rod 12 includes a first push rod portion 121 and a second push rod portion 122, and the second push rod portion 122 is configured to telescopically slide on the third sliding sleeve 16. When the folding tent is in the retracted state, an end of the push rod 12 away from a hinged position thereof with the first sliding sleeve 14 is at an innermost position. When the folding tent is in the extended state, the end of the push rod 12 away from the hinged position thereof with the first sliding sleeve 14 is at an outermost position. When the folding tent is converted from the retracted state to the extended state, the diagonal draw rod 13 drives the second sliding sleeve 15 to move outward along the folding top rod 8, and drives the push rod 12 to move outward, and a sliding stroke of the second sliding sleeve 15 is between the third sliding sleeve 16 and a hinged position of the folding top rod 8 and the leg tube top member 7.

Further, the second sliding sleeve 15 is provided with a second hinged lug 151, and the second hinged lug 151 is configured to be hingedly cooperated with one end of the diagonal draw rod 13, and the other end of the diagonal draw rod 13 is hingedly cooperated with the folding diagonal rod 9, the second sliding sleeve 15 being further provided with a second push rod perforation 152 and a second folding top rod perforation 153, an upper central portion of the second sliding sleeve 15 is provided with a second cornice rod placement groove 154. When the folding tent is in the retracted state, the cornice rod 11 is placed on the second cornice rod placement groove 154.

Further, the third sliding sleeve 16 is provided with a third hinged lug 161, and the third hinged lug 161 is configured to be hingedly cooperated with the folding diagonal rod 9, the third sliding sleeve 16 being further provided with a third push rod perforation 162 and a third folding top rod perforation 163, an upper central portion of the third sliding sleeve 16 is provided with a third cornice rod placement groove 164. When the folding tent is in the retracted state, the cornice rod 11 is placed on the third cornice rod placement groove 164.

Figure 11:
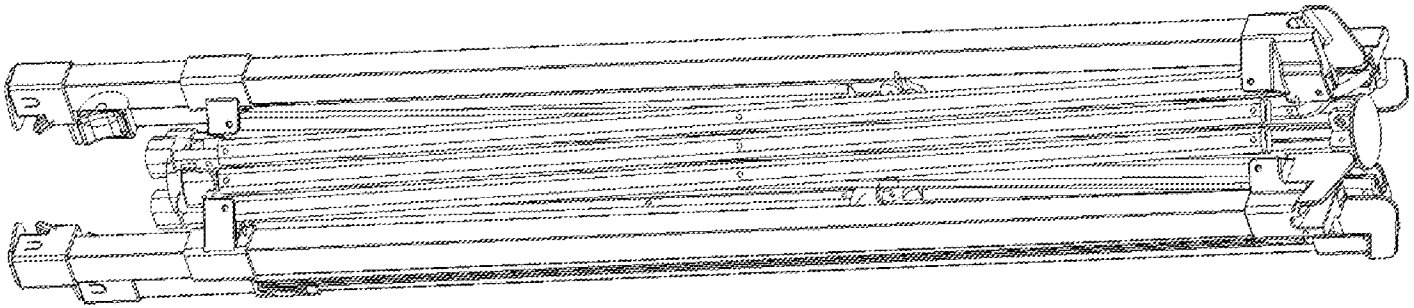
FIG. 11 is a schematic diagram of an overall retraction structure of the present invention.
Figure 12:
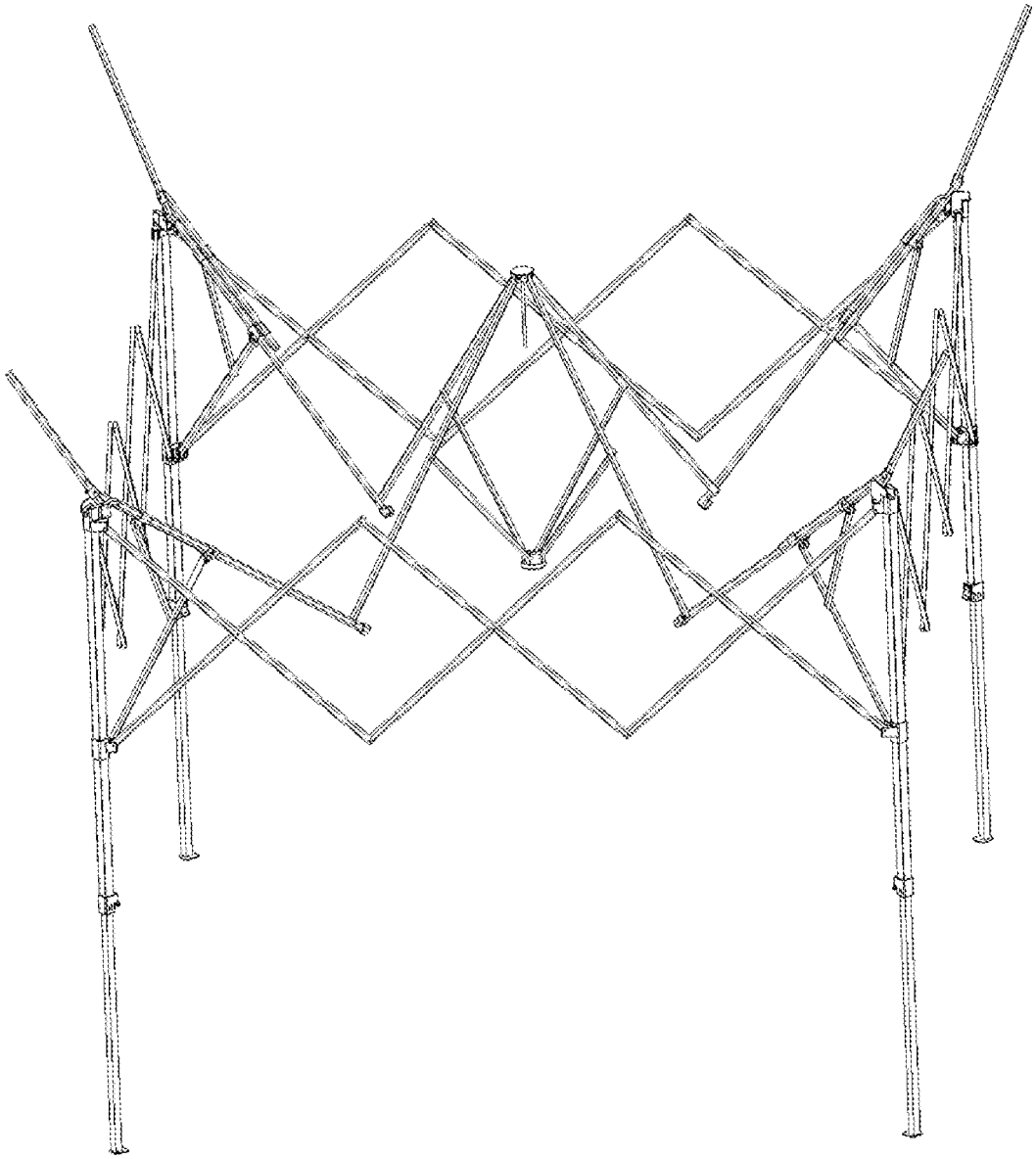
FIG. 12 is a view of the overall semi-open structure of the present invention.
Figure 13:
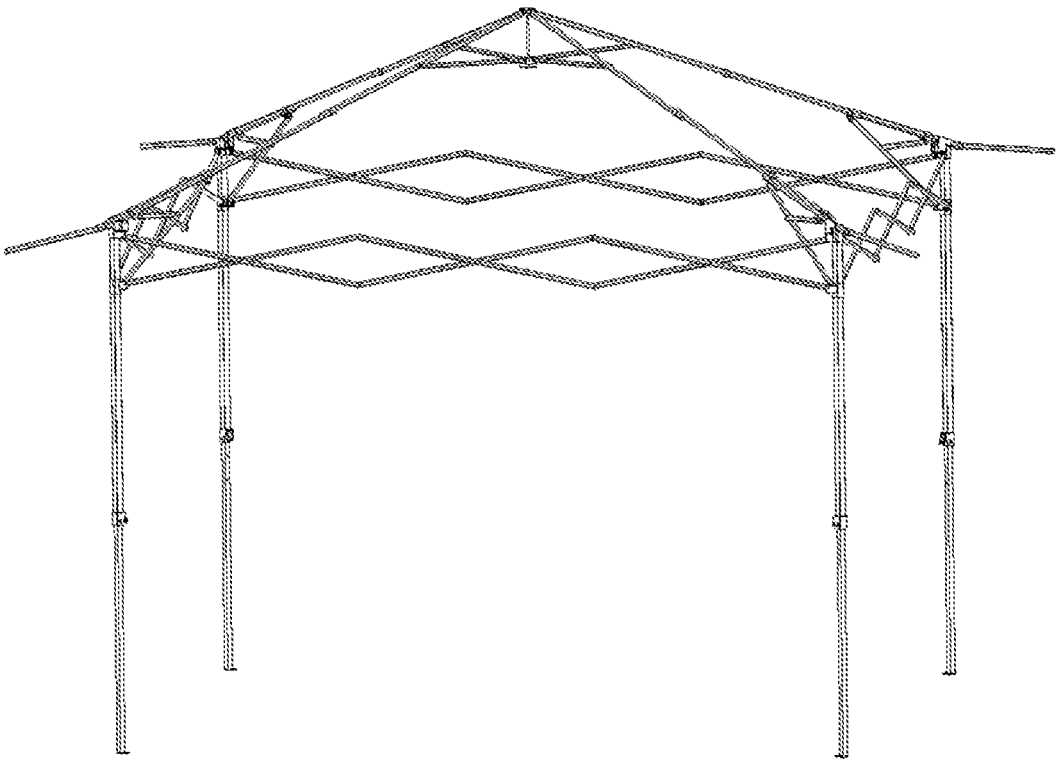
FIG. 13 is a view of the overall expansion structure of the present invention with another angle.

When the folding tent is in a retracted state as shown in FIG. 11, by pulling the leg tube 2, and transitioning to FIG. 12 gradually to be in a half-open state, the leg tube 2 is continuously pulled and the central lock assembly 5 is locked. At this stage, the cornice assembly 1 gradually enters the startup state, and gradually transitions to FIG. 13 to complete the expansion of the entire folding tent.

Among them, the folding diagonal rod is hinged at one end to the leg tube slider and the other end is hinged to the third hinged lug. As the leg tube slider moves upwards, the folding top rod is supported to extend upward by supporting the third hinged lug, and the positional change of the diagonal draw rod is caused by the continuous movement of the folding diagonal rod. Then, the diagonal draw rod drives the second sliding sleeve to slide outward along the folding top rod, and the second sliding sleeve synchronously drives the push rod to slide outward, and the push rod drives the first sliding sleeve to slide along the cornice rod for limiting position. When the push rod drives the first sliding sleeve to slide close to or in the hinged position of the cornice rod and the leg tube top member, since the cornice rod is continuously subjected to a pushing force of the push rod, and the first sliding sleeve continues to be subjected to an outward sliding force, the cornice rod passes through the hinged point of the leg tube top member, thereby achieving a 180° rapid turning, wherein the 180° turning angle will have a certain angular deviation due to the arrangement of the product rods, which does not represent the 180° turning of the absolute degree. When the cornice rod is turned over, the continuous thrust of the push rod is released, thereby continuing to slide the first sliding sleeve outward for a certain stroke until the folding tent is fully opened. If it is necessary to retract, a moving direction and the force of the components in the opposite state may be completed.

In the present invention, the optimized design uses three different connecting sleeve structures to achieve force transmission between the rods, wherein the first sliding sleeve is designed to achieve positional movement on the cornice rod, and the push rod is used to drive the driving output of the sliding of the first sliding sleeve, so that the force receiving point of the cornice rod may be changed, and is not restricted by the force of the fixed connecting point. In addition, the push rod may be used in combination to slide back and forth along a direction of the folding top rod, which increases a moving stroke of the push rod, so that, a length of the push rod itself may be shortened, and the material cost may be reduced under the premise of ensuring that the push rod drives the entire stroke of the first sliding sleeve while avoiding interference with other rods due to the addition of push rods and their length being too long. The second sliding sleeve is used for inputting the driving force of the push rod, and at the same time, the second sliding sleeve is optimized to be slidable along the folding top rod, which is convenient for realizing the limitation of a stroke direction of the push rod. A third sliding sleeve is added, and the push rod slides on the third sliding sleeve, thereby increasing the sliding stability of the push rod.

The design feature of the present invention is that based on the folding open structure of the folding tent itself, a diagonal draw rod is added to realize the output of the driving force, and the second sliding sleeve and the push rod are combined to realize the secondary transmission while completing the force output of the cornice rod by using the first sliding sleeve, thereby realizing the turning movement of the cornice rod and completing the turning of the cornice.

By optimizing the design, the present invention optimizes the movable structure of the push rod, and adopts a structural design in which the center is fixedly combined with the two ends for sliding, so that the push rod can achieve good smoothing, shortening the length of the push rod and avoiding interference. In addition, by combining the first sliding sleeve with the push rod, the force receiving point of the cornice rod can be in an active state, which facilitates the turning of the cornice rod. At the same time, the cornice rod is limited by the first sliding sleeve and the push rod to increase the stability of the cornice.

The above description is only a preferred embodiment of the present invention, and is not intended to limit the present invention in any way. Any simple modifications, equivalent changes, or modifications made to the above embodiments in accordance with the technical principles of the present invention are still within the scope of the present invention.

What is claimed is:

1. A folding tent with automatic cornice structure, comprising a folding tent body including a leg tube and a folding rod assembly, wherein the folding rod assembly is attached to a leg tube slider and a leg tube top member, the leg tube slider is slidably sleeved on the leg tube, the leg tube top member is disposed at a top portion of the leg tube, and the folding tent further comprising a cornice assembly including a connection sleeve group that includes a first sliding sleeve, a second sliding sleeve and a third sliding sleeve, and a cornice rod group that includes a cornice rod, a diagonal draw rod and a push rod, wherein the first sliding sleeve is slidably coupled with the cornice rod and is hingedly coupled with the push rod, the second sliding sleeve is fixedly coupled with the push rod, is slidably coupled with a folding top rod of the folding rod assembly, and is hingedly coupled with the diagonal draw rod, and the third sliding sleeve is fixedly coupled with the folding top rod, and is hingedly coupled with a folding diagonal rod of the folding rod assembly.

2. The folding tent with automatic cornice structure according to claim 1, wherein when the folding tent is in a retracted state, an open end of the cornice rod is in an inward position; when the folding tent is in an extended state, the open end of the cornice rod is in an outward position; when the folding tent is converted from the retracted state to the extended state, the first sliding sleeve gradually slides toward a hinge end of the cornice rod, and when the first sliding sleeve slides to an extreme position, the cornice rod starts to flip, and the first sliding sleeve gradually slides toward the open end of the cornice rod until the folding tent is fully opened; a pitch is provided between the extreme position and a position of the hinged end of the cornice rod.

3. The folding tent with automatic cornice structure according to claim 2, wherein when the folding tent is in the retracted state, an end of the push rod away from a hinged position thereof with the first sliding sleeve is at an innermost position; when the folding tent is in the extended state, the end of the push rod away from the hinged position thereof with the first sliding sleeve is at an outermost position; when the folding tent is converted from the retracted state to the extended state, the diagonal draw rod drives the second sliding sleeve to move outward along the folding top rod, and drives the push rod to move outward, and a sliding stroke of the second sliding sleeve is between the third sliding sleeve and a hinged position of the folding top rod and the leg tube top member.

4. The folding tent with automatic cornice structure according to claim 3, wherein a middle portion of the push rod is fixedly mounted with the second sliding sleeve, one end of the push rod is hingedly mounted to the first sliding sleeve, and the other end of the push rod is slidably sleeved in the third sliding sleeve, and the third sliding sleeve is slidable along the push rod.

5. The folding tent with automatic cornice structure according to claim 4, wherein the push rod includes a first push rod portion and a second push rod portion, and the second push rod portion is configured to telescopically slide in the third sliding sleeve.

6. The folding tent with automatic cornice structure according to claim 1, wherein one end of the cornice rod is hingedly coupled with the leg tube top member, and the first sliding sleeve is slid along the cornice rod by pushing of the push rod.

7. The folding tent with automatic cornice structure according to claim 1, wherein the leg tube top member is provided with a cornice rod mounting groove and a folding top rod hinge groove, and the cornice rod is hingedly coupled with a groove wall of the cornice rod mounting groove.

8. The folding tent with automatic cornice structure according to claim 7, wherein one side of the cornice rod mounting groove is provided with a push rod placement groove.

9. The folding tent with automatic cornice structure according to claim 1, wherein the second sliding sleeve is provided with a second hinged lug configured to be hingedly coupled with one end of the diagonal draw rod, and the other end of the diagonal draw rod is hingedly coupled with the folding diagonal rod, and the second sliding sleeve is further provided with a second push rod perforation and a second folding top rod perforation.

10. The folding tent with automatic cornice structure according to claim 1, wherein the third sliding sleeve is provided with a third hinged lug configured to be coupled with the folding diagonal rod, and the third sliding sleeve is further provided with a third push rod perforation and a third folding top rod perforation.

* * * * *